US005994288A

United States Patent [19]

Urfer et al.

[11] Patent Number: 5,994,288

[45] Date of Patent: Nov. 30, 1999

[54] PROCESS FOR PREPARING SOLID CAST DETERGENT PRODUCTS

[75] Inventors: Allen D. Urfer, Plainfield, Ind.; Virginia L. Lazarowitz, Hatfield, Pa.

[73] Assignee: Henkle Corporation, Gulph Mills, Pa.

[21] Appl. No.: 09/028,423

[22] Filed: Feb. 24, 1998

Related U.S. Application Data

[62] Division of application No. 08/595,119, Feb. 1, 1996.

[51] Int. Cl.[6] ..... C11D 3/22; C11D 7/32; C11D 11/00

[52] U.S. Cl. ..... 510/470; 510/224; 510/350; 510/535

[58] Field of Search ..... 510/224, 350, 510/470, 535

[56] References Cited

U.S. PATENT DOCUMENTS

| | | | |
|---|---|---|---|
| Re. 32,763 | 10/1988 | Fernholtz et al. | 510/535 |
| 4,595,520 | 6/1986 | Heile et al. | 510/535 |
| 4,846,989 | 7/1989 | Killa | 510/470 |
| 5,266,690 | 11/1993 | McCurry, Jr. et al. | 510/470 |
| 5,454,982 | 10/1995 | Murch et al. | 510/470 |

*Primary Examiner*—Jacqueline V. Howard
*Attorney, Agent, or Firm*—Ernest G. Szoke; Wayne C. Jaeschke; Steven J. Trzaska

[57] ABSTRACT

A process for forming solid cast detergent products comprising the steps of: (a) forming an aqueous detergent slurry comprising from about 60 to about 90 parts by weight of solid detergent ingredients, per 100 parts of total detergent slurry weight, said solid detergent ingredients comprising: (i) from about 5 to about 50 parts by weight of a surfactant; (ii) from about 0.1 to about 10 parts by weight of a salt-form builder component; (iii) from about 30 to about 75 parts by weight of a hydrated alkaline component;
(b) adding from about 0.5 to about 10 parts by weight of a sugar surfactant selected from the group consisting of an alkyl polyglycoside, a glucamide, and mixtures thereof, to form a uniform dispersion; and (c) casting said uniform dispersion to form a solid cast detergent product.

22 Claims, No Drawings

PROCESS FOR PREPARING SOLID CAST DETERGENT PRODUCTS

This application is a division of Ser. No. 08/595,119 filed Feb. 1, 1996.

FIELD OF THE INVENTION

The present invention generally relates to a process for preparing solid cast detergent products from aqueous detergent slurries. More particularly, the present invention provides for the production and hardness control of cast detergent products having very high solids contents by reducing the initial viscosity of aqueous detergent slurries used to make solid cast detergent products.

BACKGROUND OF THE INVENTION

In the manufacture of powdery or granular detergent compositions, it is common practice to prepare a relatively high solids aqueous crutcher slurry containing a surfactant ingredient, a builder ingredient and water. The crutcher slurry is then spray dried to form the desired powdery or granular detergent product.

When preparing a powdered or granular detergent in the foregoing fashion, there is a significant economic incentive to minimize the amount of water present in, and to maximize the dry solids content of, the crutcher slurry, thereby reducing the amount of energy required in drying the slurry to form the desired granular or powdered detergent product. Naturally, however, there are also practical upper limits within actual granular or powdered detergent manufacturing operations upon the maximum solids content which can be achieved while still providing a pumpable/sprayable slurry as well as upon the combinations of ingredients, suitable for preparing stable, homogeneous high solids aqueous crutcher slurries or suspensions.

While attempts at increasing the solids content of aqueous crutcher slurries used to form granular and powdered detergent products have shown to be successful, their use in today's institutional and industrial spray washing machines is not pragmatic for various reasons. In the past, conventional institutional and industrial spray washing machines employed liquid or powdered detergents which were generally added to the wash tank by means of an automatic dispenser system. All forms of such detergents, whether liquid or solid, have stability problems and other problems associated with their manufacture, dispensing or use. Moreover, in the early days of the development of solid detergents, when these detergent products were relatively low in performance compared to the products of today, the problems were less severe. However, the advent of high performance products stimulated in part by increased aesthetic and sanitary standards and a demand for shorter wash times has generally been characterized by the development of more complex detergent compositions which are more hazardous to the user, less stable, and more difficult to dissolve in a satisfactory uniform manner.

For example, higher performance solid detergents generally means higher alkalinity, i.e., greater concentrations of sodium hydroxide, higher to the point of posing safety hazards to the user. Historically, detergents used for warewashing have been relatively low in alkalinity. The extensive use of aluminum trays and utensils, the presence of soft metals in wash pump impellers and other factors generally prevented the use of high alkalinity detergents. Today, however, there has been a trend toward the use of high alkalinity, higher performance products. This trend has been partially the result of the increased usage of stainless steel and corrosion resistant plastics in the production of utensils. In addition, the aforementioned increased standards and shorter wash times required by the increased volume of business in eating establishments have created a demand for these higher performance products.

In an effort to minimize the contact between the user and the detergent composition, solid cast detergents have been introduced. These detergents originate in aqueous form and are subsequently cast (hardened) into a solid homogenous block of detergent. These detergent blocks are then inserted into warewashing machines and dispensed by spraying water over the block, thereby releasing a predetermined amount of the detergent for use in cleaning.

While cast detergent products by and large provide adequate cleaning and wash times, there still exists a need for more concentrated cast detergent products which provide greater cleansing power in even shorter time periods. One way to meet these demands is by increasing the solids content of the cast detergent product, thereby providing for a more concentrated product having increased levels of cleaning ingredients.

Moreover, by increasing the solids content of the aqueous detergent slurries used to make the solid cast product, less time and energy are required for the product to cast (harden). Hence, by increasing solids content, a more concentrated and cost-efficient product is formed.

The mere addition of more solid detergent ingredients to an aqueous slurry, however, is not the solution since an increase in solid ingredients alone such as anionic surfactants causes the aqueous slurry to become too viscous to handle, thereby precluding the formation of an acceptable homogeneous solid cast detergent product.

It is therefore an object of the present invention to provide a process for producing solid cast detergent products having high solids content levels by reducing the initial viscosity of the aqueous slurry prior to casting, thereby controlling both the set-up time of the slurry and the final hardness of the solid cast detergent product.

SUMMARY OF THE INVENTION

The process of the present invention relates to the production of solid-cast detergent products involving the steps of: (a) forming an aqueous detergent slurry containing, per 100 parts of total detergent slurry weight, from about 60 to about 90 parts by weight of solid detergent ingredients, said solid detergent ingredients comprising: (i) from about 5 to about 50 parts by weight of a surfactant; (ii) from about 0.1 to about 10 parts by weight of a salt-containing builder; and (iii) from about 30 to about 75 parts by weight of a hydrated alkaline component; (b) adding from about 0.5 to about 10 parts by weight of a sugar surfactant selected from the group consisting of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to bout 6, a glucamide having the general formula II:

(II)

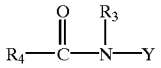

wherein $R_3$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_4$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Y is a polyhydroxyhydrocarbyl moiety having a linear hydrocarbyl chain with at least 3 hydroxyls directly connected to the chain, or an alkoxylated derivative (preferably ethoxylated or propoxylated) thereof, and mixtures thereof, to form a uniform dispersion; and (c) casting said uniform dispersion to form said solid cast detergent product.

DESCRIPTION OF THE INVENTION

Other than in the operating examples, or where otherwise indicated, all number expressing quantities of ingredients or reaction conditions used herein are to be understood as being modified in all instances by the term "about".

The foregoing and other related objects are achieved, and the disadvantages of the prior art are obviated, by the provision of the above-disclosed process. Methods of manufacturing solid cast detergent products, in general, are known in the art. It has been surprisingly found, however, that by combining an alkyl polyglycoside with a salt-form builder when formulating the aqueous detergent slurry to be cast, and manipulating the amounts of alkyl polyglycoside and salt-form builder that are used, the initial intrinsic viscosity and hardening time of the aqueous detergent slurry can be controlled in such a way that the solids content of the slurry can be significantly increased.

The initial step of the process involves forming an aqueous detergent slurry containing a salt-form builder component. The solids content of the detergent slurry will range from about 65 to about 85 parts by weight, per 100 parts of total slurry weight. To this slurry there is then added a predetermined amount of a sugar surfactant selected from the group consisting of alkyl polyglycosides, glucamides, and mixtures thereof.

The alkyl polyglycosides which can be used in the process according to the invention have the formula I $$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the process according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. APG® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.55.
3. GLUCOPON® 625 Surfactant—an alkyl polyglycoside in which the alkyl groups contains 12 to 16 carbon atoms and having an average degree of polymerization of 1.6.
4. GLUCOPON® 325 Surfactant—an alkyl polyglycoside in which the alkyl groups contains 9 to 11 carbon atoms and having an average degree of polymerization of 1.6.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and R, is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

A particularly preferred alkyl polyglycoside component for use in the present process is that of formula I wherein $R_1$ is a monovalent organic radical having from about 8 to about 16 carbon atoms, b is zero, and a is a number having the value 1.55.

The glucamides which can be used in the process of the invention to form the emulsifier are of general formula (II):

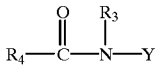

(II)

wherein: $R_3$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R_4$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Y is a polyhydroxyhydrocarbyl moiety having a linear hydrocarbyl chain with at least 3 hydroxyls directly connected to the chain, or an alkoxylated derivative (preferably ethoxylated or propoxylated) thereof. Y preferably will be derived from a reducing sugar in a reductive amination reaction; more preferably Y is a glycidyl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Y. It should be understood that it is by no means intended to exclude other suitable raw materials. Y preferably will be selected from the group consisting of $—CH_2—(CHCH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or polysaccharide, and alkoxylated derivatives thereof. Most preferred are glycidyls wherein n is 4, particularly $—CH_2—(CHOH)_4—CH_2OH$. Therefore, when, for example, $R_3$ is methyl, $R_4$ dodecyl; and Y is $—CH_2—(CHOH)_4—CH_2OH$, the compound in question is referred to as dodecyl N-methylglucamide.

Methods for making glucamides (polyhydroxy fatty acid amides) are known in the art. In general, polyhydroxy fatty acid amides can be made by reductively aminating a reducing sugar reacting with an alkyl amine to form a corresponding N-alkyl polyhydroxyamine and then reacting the N-alkyl polyhydroxyamine with a fatty aliphatic ester or triglyceride to form the N-alkyl, polyhydroxy fatty acid amide. Processes for making polyhydroxy fatty acid amides are disclosed in U.S. Pat. Nos. 1,985,424; 2,965,576; 5,194,639; and 5,334,764 the entire contents of each of which is incorporated herein by reference.

The amount of sugar surfactant employed in the present process can vary from about 0.5 to about 10 parts by weight, and preferably about 1 part by weight, per 100 parts of total slurry weight.

The surfactant component may include any surfactant typically present in institutional warewashing detergents. Examples of suitable surfactants include anionics, nonionics, cationics, amphoterics, zwitterionics and mixtures thereof. Particularly preferred surfactants are linear alkyl sulfonates. The surfactant component is present in an amount of from about 5 to about 50, and preferably about 15 parts by weight, per 100 parts total slurry weight.

The aqueous detergent slurry of the present invention will also contain from about 30 to about 75, and preferably about 40 parts by weight, per 100 parts total slurry weight, of a hydrated alkaline component. Examples of suitable alkaline components include alkali metal phosphates, alkali metal borates, alkali metal carbonates, alkali metal metasilicates, alkali metal orthosilicates, alkali metal hydroxides and mixtures thereof.

The salt-form builder components which may be used in the process of the present invention are basically the salt-form derivatives of known builder components such as, for example, chloride, sulfates, silicates, phosphates and carboxylates. Such builder components will be employed in the detergent slurry in an amount of from about 0.1 to about 10, and preferably about 4 parts by weight, per 100 parts of total slurry weight.

The aqueous detergent slurry will also contain from about 10 to about 40 parts by weight of water, per 100 parts of total slurry weight.

According to the process of the present invention, by forming an aqueous detergent slurry containing a sugar surfactant and salt-form builder component in the specified amounts, the initial intrinsic viscosity of the slurry will be from about 3,000 centipoise to about 20,000 centipoise, and preferably about 5,000 centipoise, thereby allowing for more solids to be incorporated therein when the cast solid product is formed. Moreover, by varying the amounts of sugar surfactant and salt-form builder components employed within the above-disclosed ranges, the casting (hardening) time can similarly be controlled which also affects the amount of solids which can be contained therein.

Once the initial aqueous detergent slurry is formed it is ready to be cast (hardened) into a solid cast detergent product. As was mentioned previously, by combining a sugar surfactant and salt-form builder in the disclosed amounts and ratios, not only will the resultant product have increased solids content levels, but the casting time can also be controlled. The present process allows for a casting (hardening) time of from about 1 to about 24 hours, and preferably about 2 hours.

With respect to the particular steps involved in casting solid detergents products, the methods are well known in the art. For example, two methods of manufacturing such solid cast detergent products are disclosed in U.S. Pat. Nos. 4,569,780 and 4,569,781, issued to Fernholz et al, along with U.S. Pat. No. 4,595,520, all of which are hereby incorporated by reference. Applicant would like to note, however, that these methods are cited merely as examples of possible casting methods which may be employed when forming the finished solid cast detergent product, and that Applicant's invention is in no way limited to these specific methods. This being said, regardless of the particular casting method that is employed, the crux of the present invention involves employing a sugar surfactant and salt-form builder component in an aqueous detergent slurry, in the predetermined amounts, thereby providing a process for increasing the solids content and hardening times of the finished cast solid detergent product by reducing the initial intrinsic viscosity of the formulated aqueous detergent slurry.

The present invention will be better understood from the examples which follow, all of which are intended to be illustrative only and not meant to unduly limit the scope of the invention. Unless otherwise indicated, amounts of components employed are on a parts by weight basis, per 100 parts total slurry weight.

EXAMPLES

Aqueous detergent slurries containing 72.5% solids were formed into homogenous dispersions having compositions as outlined in Table 1 below. Amounts are in parts by weight.

| | Ex.1 | C1 | Ex.2 | C2 | Ex.3 | C3 | Ex.4 | C4 |
|---|---|---|---|---|---|---|---|---|
| GLUCOPON ® 625 | 1% | — | 1% | — | — | — | 1% | — |
| APG ® 225 | — | — | — | — | 1% | — | — | — |
| NaCl | 4% | — | 4% | — | 4% | — | 4% | — |
| STPP | 35% | 35% | 35% | 35% | 30% | 30% | — | — |
| $Na_2SO_4$ | 37% | 42% | 37% | 42% | 15% | 20% | 20% | 25% |
| $Na_2CO_3$ | — | — | — | — | 20% | 20% | 52% | 52% |
| LAS | 16% | 16% | 12% | 12% | 20% | 20% | 16% | 16% |
| LAE | — | — | 4% | 4% | — | — | — | — |
| silicate | 7% | 7% | 7% | 7% | 1O% | 1O% | 7% | 7% |
| visc. ('000) (centipoise) | 17 | 56 | 20 | 380 | 11.4 | 7400 | 6 | 29 |

As can be seen from the results obtained in Table I above, by combining an alkyl polyglycoside with a salt-forming builder in the disclosed amounts during the formation of the detergent slurry, the initial intrinsic viscosity thereof is significantly reduced, thereby allowing the introduction of more solids into the slurry. Consequently, after the slurries are poured into a cast mold and harden, a solid cast product is formed having a high solids content.

What is claimed is:

1. A process for forming solid cast detergent products comprising the steps of:

(a) forming an aqueous detergent slurry comprising from about 60 to about 90 parts by weight of solid detergent ingredients, per 100 parts of total detergent slurry weight, said solid detergent ingredients comprising:

(i) from about 5 to about 50 parts by weight of a surfactant;

(ii) from about 0.1 to about 10 parts by weight of a salt-form builder component;

(iii) from about 30 to about 75 parts by weight of a hydrated alkaline component;

(b) adding from about 0.5 to about 10 parts by weight of a mixture of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and a glucamide having the general formula II:

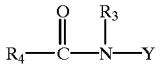

(II)

wherein $R_3$ is H, $C_1$–$C_4$ hydrocarbyl, 2-hydroxy ethyl, 2-hydroxy propyl, or a mixture thereof; and $R_4$ is a $C_5$–$C_{31}$ hydrocarbyl moiety; and Y is a polyhydroxyhydrocarbyl moiety having a linear hydrocarbyl chain with at least 3 hydroxyls directly connected to the chain, or an alkoxylated derivative thereof, to form a uniform dispersion; and (c) casting said uniform dispersion to form a solid cast detergent product.

2. The process of claim 1 wherein said surfactant is selected from the group consisting of anionics, nonionics, amphoterics, cationics, zwitterionics and mixtures thereof.

3. The process of claim 1 wherein said salt-form builder component is selected from the group consisting of sodium chloride, sodium sulfate, sodium silicate, sodium carboxylates, sodium phosphate and mixtures thereof.

4. The process of claim 1 wherein said hydrated alkaline component is selected from the group consisting of alkali metal phosphates, alkali metal borates, alkali metal carbonates, alkali metal metasilicates, alkali metal orthosilicates, alkali metal hydroxides, and mixtures thereof.

5. The process of claim 1 wherein said mixture is added in an amount of about 1 part by weight, based on the weight of the slurry.

6. The process of claim 5 wherein in said alkyl polyglycoside of formula I $R_1$ is a monovalent organic radical having from 8 to 16 carbon atoms; b is zero; a is a number having a value of 1.55.

7. The process of claim 1 wherein said castable uniform dispersion has an initial intrinsic viscosity of from about 3,000 to about 20,000 centipoise.

8. The process of claim 2 wherein said surfactant is a linear alkyl sulfonate.

9. The process of claim 1 wherein said slurry contains from about 10 to about 40 parts by weight of water, based on the weight of the slurry.

10. The process of claim 1 wherein said castable uniform dispersion has a hardening time of from about 1 to about 24 hours.

11. The product of the process of claim 1.

12. The product of the process of claim 2.

13. The product of the process of claim 3.

14. The product of the process of claim 4.

15. The product of the process of claim 5.

16. The product of the process of claim 6.

17. The product of the process of claim 7.

18. The product of the process of claim 8.

19. The product of the process of claim 9.

20. The product of the process of claim 10.

21. A process for forming solid cast detergent products comprising the steps of;

(a) forming an aqueous detergent slurry comprising about 70 parts by weight of solid detergent ingredients, per 100 parts of total detergent slurry weight, said solid detergent ingredients comprising:

(i) about 15 parts by weight of a linear alkyl sulfonate;

(ii) about 4 parts by weight of a salt-form builder component selected from the group consisting of sodium chloride, sodium sulfate, sodium silicate, sodium carboxylate and mixtures thereof;

(iii) about 40 parts by weight of a hydrated alkaline component;

(b) adding about 1 part by weight of a mixture of an alkyl polyglycoside having the general formula I:

$$R_1O(R_2O)_b(Z)_a \quad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6; and a glucamide having the general formula II:

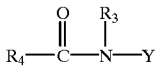

(II)

wherein $R_3$ is H, $C_1$–$C_4$ hydrocarbyl, 2-hydroxy ethyl, 2-hydroxy propyl, or a mixture thereof; and $R_4$ is a $C_5$–$C_{31}$ hydrocarbyl moiety; and Y is a polyhydroxyhydrocarbyl moiety having a linear hydrocarbyl chain with at least 3 hydroxyls directly connected to the chain, or an alkoxylated derivative thereof, to form a uniform dispersion; and (c) casting said uniform dispersion to form a solid cast detergent product.

22. The process of claim 21 wherein in formula I $R_1$ is a monovalent organic radical having from 8 to 16 carbon atoms; b is zero; a is a number having a value of 1.55.

* * * * *